US009617789B2

(12) United States Patent
Shipp

(10) Patent No.: US 9,617,789 B2
(45) Date of Patent: Apr. 11, 2017

(54) POWER SECTION AND BEARING SECTION OF DOWNHOLE MOTOR

(71) Applicant: Accel Directional Drilling, Conroe, TX (US)

(72) Inventor: Chris Shipp, Montgomery, TX (US)

(73) Assignee: Accel Directional Drilling, Conroe, TX (US)

( * ) Notice: Subject to any disclaimer, the term of this patent is extended or adjusted under 35 U.S.C. 154(b) by 281 days.

(21) Appl. No.: 14/273,084

(22) Filed: May 8, 2014

(65) Prior Publication Data

US 2015/0322718 A1 Nov. 12, 2015

(51) Int. Cl.
*E21B 4/02* (2006.01)
*E21B 4/00* (2006.01)
*E21B 7/04* (2006.01)

(52) U.S. Cl.
CPC ..... *E21B 4/02* (2013.01); *E21B 4/003* (2013.01); *E21B 7/04* (2013.01)

(58) Field of Classification Search
CPC ..... E21B 4/02; E21B 4/003; E21B 7/04
See application file for complete search history.

(56) References Cited

U.S. PATENT DOCUMENTS 2,984,219 A * 5/1961 Mitchell ..... E21B 4/02 418/153
2003/0111269 A1* 6/2003 Blair ..... E21B 4/003 175/101
2005/0132794 A1* 6/2005 Spross ..... E21B 7/067 73/152.03
2006/0243487 A1* 11/2006 Turner ..... E21B 7/062 175/26
2011/0088952 A1* 4/2011 Young ..... E21B 4/003 175/101
2012/0228035 A1 9/2012 Gillis
2012/0325561 A1 12/2012 LeBlanc et al.
2013/0341099 A1 12/2013 Gillis
2014/0209389 A1* 7/2014 Sugiura ..... E21B 7/067 175/73
2015/0101864 A1* 4/2015 May ..... E21B 44/00 175/27
2015/0129311 A1* 5/2015 Regener ..... E21B 3/00 175/61
2015/0167390 A1* 6/2015 Murray ..... E21B 7/067 175/57

* cited by examiner

*Primary Examiner* — Shane Bomar
(74) *Attorney, Agent, or Firm* — Kinney & Lange, P.A.

(57) ABSTRACT

A motor assembly includes a power section extending between a first end and a second end. A bearing assembly section is disposed downhole from the second end of the power section. The outer diameter of the power section is smaller than an outer diameter of the bearing assembly section.

14 Claims, 2 Drawing Sheets

POWER SECTION AND BEARING SECTION OF DOWNHOLE MOTOR

BACKGROUND OF INVENTION

The present invention relates generally to drilling subterranean boreholes and, more specifically, to a downhole motor for drilling curved and horizontal boreholes.

Subterranean boreholes are typically drilled using a drill bit connected to a distal end of a drill string made up of coiled tubing or sections of drill pipe connected in series by drill collars. The drill bit is rotated by rotating the entire drill string, and/or the drill bit is rotated by a downhole motor which is included as a component of the drill string. Drilling fluid is typically pumped down through the drill string to the bottom of the borehole and back up the annulus between the drill string and the wall of the borehole. The drilling fluid cools the drill bit and removes the cuttings resulting from the drilling operation. In the instances where the drill bit is rotated by a downhole motor, such as a progressing cavity motor, the drilling fluid can also supply hydraulic power to operate the downhole motor.

In addition to rotating the drill bit to progress the borehole and the drill string into a formation, the downhole motor can be configured to control and orientate the drilling direction of the drill bit, such as in the case of a bent downhole motor. Bent downhole motors generally include a bend that allows the bent downhole motor to guide the drill bit and drill string along a curved path away from a vertical drilling direction to a horizontal drilling direction. The curved path is generally considered to have a short radius curve when the size of the radius of the curved path is less than approximately 80 feet (24 meters). The curved path is generally considered to have a long radius curve when the size of the radius of the curved path is greater than approximately 800 feet (240 meters). The curved path is generally considered to have a medium radius curve when the size of the radius is anywhere between that of a short radius and a long radius. Boreholes with medium radius curves and short radius curves can be technically more challenging and costly to drill than a borehole with a long radius curve, however, a borehole with a long radius curve can be impractical or impossible to drill where property and lease boundary restrictions limit the horizontal space in which the borehole can extend to reach a target.

Typically, drilling operators limit the use of short radius and medium radius curves to boreholes with diameters smaller than 9 inches (23 centimeters), such as a borehole with a diameter of 8.25 inches (20.9 centimeters). While drilling boreholes with a short radius or medium radius curve and a diameter larger than 9 inches (23 centimeters) are easier to case (due to less friction and drag between the case and the wall of the borehole) and allow a larger variety of case sizes than a borehole with a similar curve but a smaller borehole diameter, drilling operators do not typically drill boreholes with a short radius or medium radius curve and a diameter larger than 9 inches (23 centimeters) because drilling a borehole with a diameter larger than 9 inches (23 centimeters) and with a short or medium radius curve is more time consuming and therefore more costly.

SUMMARY

In one aspect, a motor assembly includes a power section extending between a first end and a second end. A bearing assembly section is disposed downhole from the second end of the power section. The outer diameter of the power section is smaller than an outer diameter of the bearing assembly section.

Figure 1:
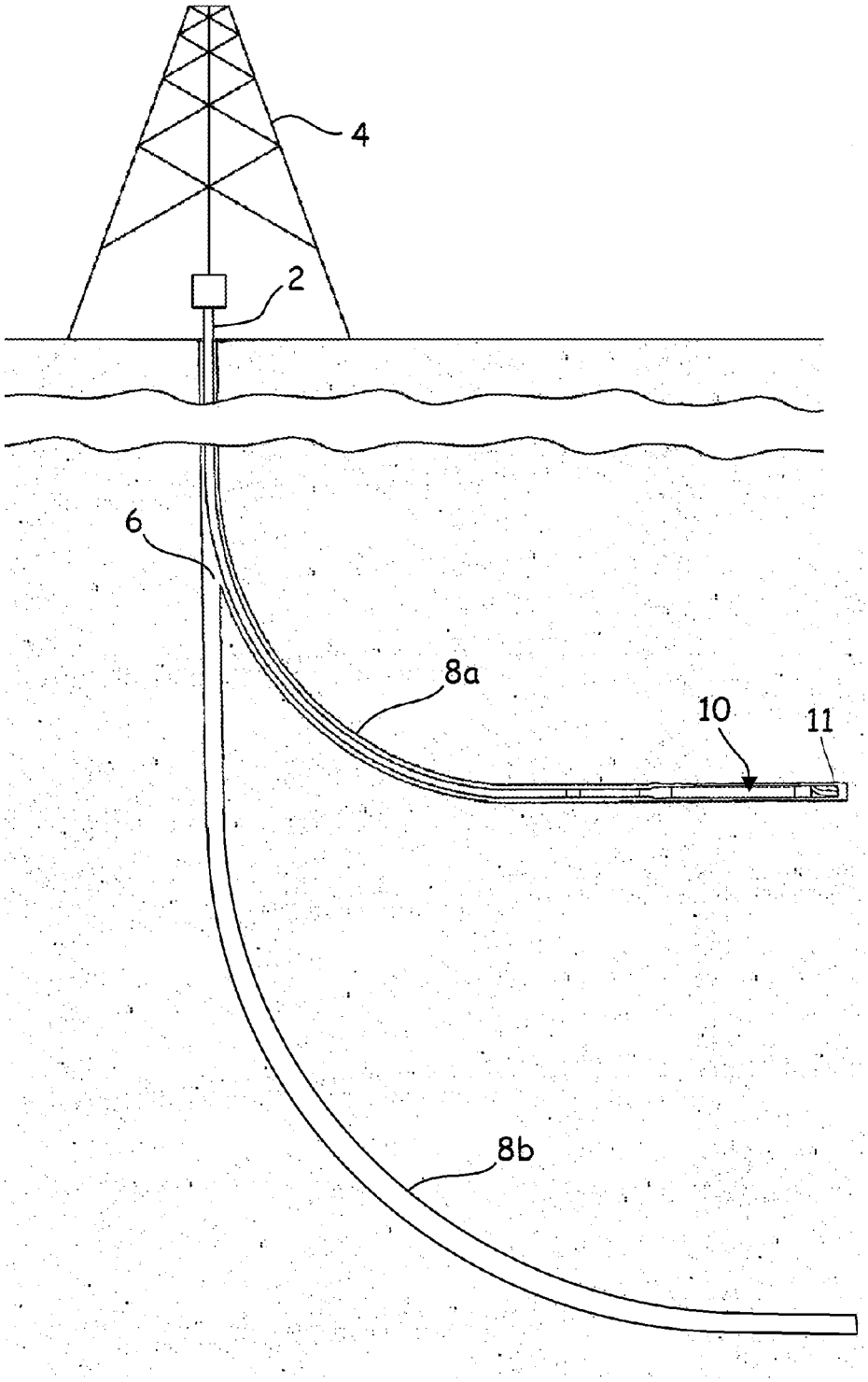
FIG. 1 depicts a cross-sectional view of an embodiment of a drill string suspended in a borehole.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

In general, the principles described herein provide a motor assembly with a power section and a bearing assembly section. The power section has a smaller outer diameter than an outer diameter of the bearing assembly section. A ratio of the outer diameter of the power section to the outer diameter of the bearing assembly section can be approximately 0.7307 to approximately 0.8709, and the outer diameter of the power section can be approximately 1 inch (2.54 centimeters) to approximately 2.25 inches (5.715 centimeters) smaller than the outer diameter of the bearing assembly section. As discussed below with reference to FIGS. 2 and 3, initial testing has discovered that the present invention can assist in drilling short radius and medium radius curves in relatively large subterranean boreholes-boreholes with a diameter larger than 9 inches (23 centimeters)—at a much faster rate and lower cost than prior art motor assemblies.

Referring now to the figures, FIG. 1 depicts a cross-sectional view of an embodiment of drill string 2 suspended in subterranean borehole 6 by derrick 4. Borehole 6 can include short radius curve 8*a* and medium radius curve 8*b*. Borehole 6 can have a diameter larger than 9 inches (23 centimeters). Short radius curve 8*a* can have a radius that is less than approximately 80 feet (24 meters). Medium radius curve 8*a* can have a radius that is between approximately 80 feet (24 meters) and 800 feet (240 meters) in length. Drill string 2 includes downhole motor assembly 10 and drill bit 11 for forming borehole 6 and curves 8*a* and 8*b*. As discussed below, motor assembly 10 is configured such that drill string 2 is able to form borehole 6 and curves 8*a* and 8*b* faster than prior art assemblies.

Figure 2:
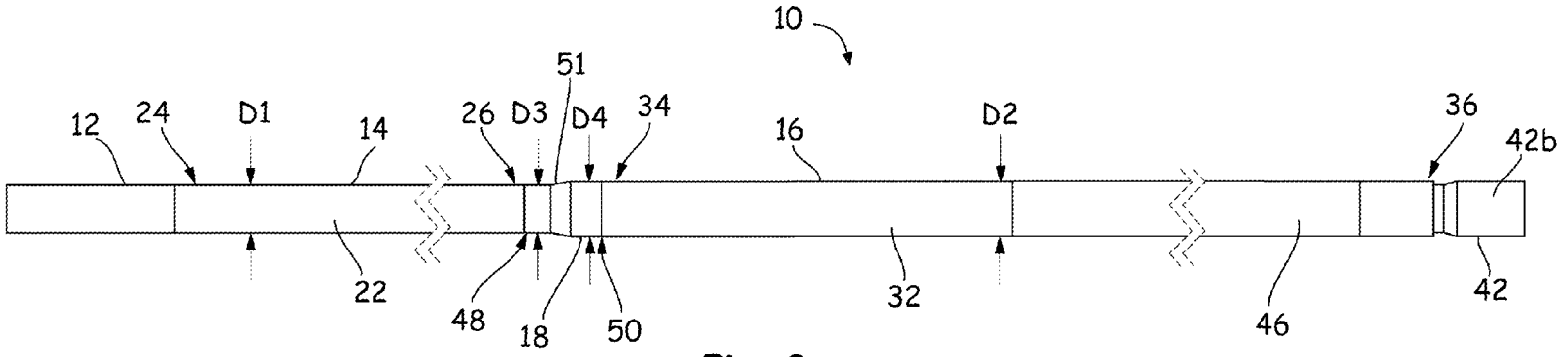
FIG. 2 depicts a side view of an embodiment of a power section and a bearing assembly section of a downhole motor assembly.
Figure 3:
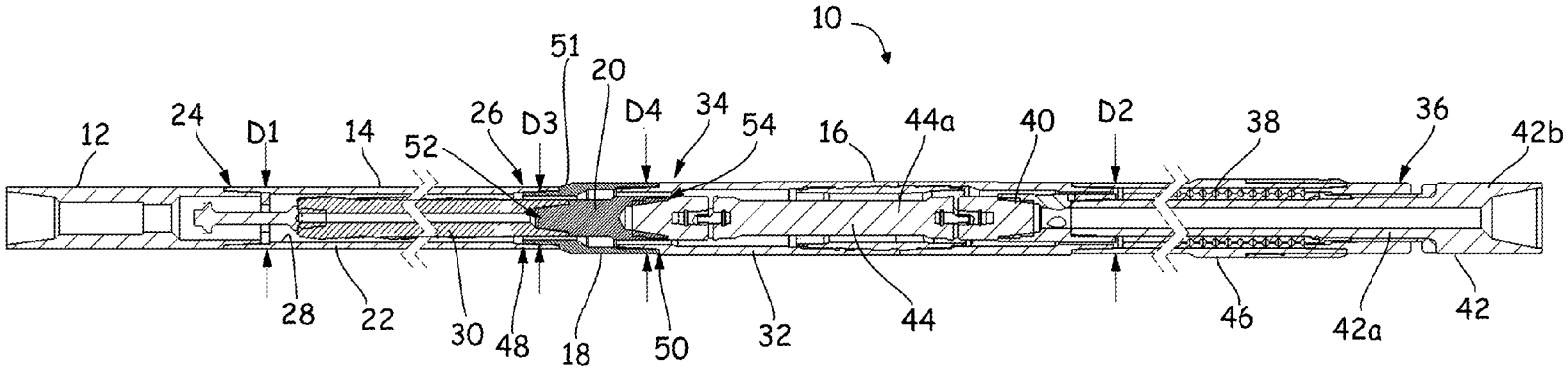
FIG. 3 depicts a cross-sectional view of the power section and the bearing assembly section of the downhole motor assembly of FIG. 2.

FIGS. 2 and 3 will be discussed concurrently. FIG. 2 depicts a side view of an embodiment of motor assembly 10, and FIG. 3 depicts a cross-sectional view of motor assembly 10 of FIG. 2. As shown in FIGS. 2 and 3, motor assembly 10 can include top sub 12, power section 14, bearing assembly section 16, outer crossover sub 18, and inner crossover sub 20. Power section 14 can include housing 22, first end 24, second end 26, outer diameter D1, stator 28, and rotor 30. Bearing assembly section 16 can include housing 32, first end 34, second end 36, outer diameter D2, radial bearings 38, thrust bearings 40, mandrel bit box 42, transmission assembly 44, and sleeve 46. Outer crossover sub 18 can include first end 48 with outer diameter D3, and second end 50 with outer diameter D4. Inner crossover sub 20 can include first end 52 and second end 54.

Housing 22 of power section 14 can be generally cylindrical and extends between first end 24 and second end 26 of power section 14. Housing 22 of power section 14 can form outer diameter D1 of power section 14. Stator 28 of power section 14 is disposed radially within housing 22 and extends between first end 24 and second end 26 of power section 14. Stator 28 can be formed integrally with housing 22. Rotor 30 of power section 14 is disposed radially within stator 28. Stator 28 and rotor 30 can be configured as a progressing cavity motor such that rotor 30 rotates within stator 28 as drilling fluid flows across power section 14 between stator 28 and rotor 30. Top sub 12 can be connected to housing 22 of power section 14 at first end 24. Top sub 12 can be configured to connect motor assembly 10 to a drill string assembly for drilling subterranean boreholes.

Bearing assembly section 16 is disposed downhole from second end 26 of power section 14 and can be connected to power section 14 by outer crossover sub 18 and inner crossover sub 20. The term 'downhole' can be defined as a position on an assembly that would be located further down a borehole relative a reference position should the assembly be inserted into the borehole. Housing 32 of bearing assembly section 16 can be generally cylindrical and can extend between first end 34 and second end 36. Housing 32 of bearing assembly section 16 can define outer diameter D2 of bearing assembly section 16. Sleeve 46 can be disposed around housing 32 and outer diameter D2 of bearing assembly section 16 and radially outward of outer diameter D2. Sleeve 46 can be a stabilizer sleeve or a slick sleeve. Outer crossover sub 18 can be disposed between first end 34 of bearing assembly section 16 and second end 26 of power section 14 and can connect housing 32 of bearing assembly section 16 to housing 22 of power section 14.

Mandrel bit box 42 can be disposed proximate second end 36 of bearing assembly section 16. Mandrel bit box 42 can include shaft 42*a* and connecting head 42*b*. Shaft 42*a* of mandrel bit box 42 can extend into housing 32 of bearing assembly section 16 at second end 36. Connecting head 42*b* of mandrel bit box can extend from shaft 42*a* downhole from housing 32 of bearing assembly section 16 and can be configured to connect a drill bit and/or drill tools to bearing assembly section 16. Radial bearings 38 and thrust bearings 40 can be disposed between shaft 42*a* of mandrel bit box 42 and housing 32 of bearing assembly section 16. Radial bearings 38 and thrust bearings 40 help shaft 42*a* of mandrel bit box 42 rotate relative housing 32 of bearing assembly section 16 and also help transfer radial and axial loads between mandrel bit box 42 and housing 32 of bearing assembly section 16.

Transmission assembly 44 can be disposed within housing 32 of bearing assembly section 16 uphole from shaft 42*a* of mandrel bit box 42. Inner crossover sub 18 can be disposed within outer crossover sub 18 and disposed between transmission assembly 44 and rotor 30 of power section 14. First end 52 of inner crossover sub 20 is connected to rotor 30 and second end 54 of inner crossover sub 20 is connected to transmission assembly 44 such that inner crossover sub 20 can transfer torque from rotor 30 of power section 14 to transmission assembly 44. Transmission assembly 44 is further connected to shaft 42*a* of mandrel bit box 42 such that transmission assembly transfers torque from rotor 30 of power section 14 to mandrel bit box 42. Transmission assembly 44 can include flex shaft 44*a*. In configurations of motor assembly 10 where housing 32 of bearing assembly section 16 is bent, flex shaft 44*a* is sufficiently elastic to extend across bent housing 32 to transmit toque from rotor 30 to mandrel bit box 42. As discussed below, outer diameter D1 of power section 14 is smaller than outer diameter D2 of bearing assembly section 16.

Outer diameter D1 of power section 14 can be approximately 1 inch (2.54 centimeters) to approximately 2.25 inches (5.715 centimeters) smaller than outer diameter D2 of bearing assembly section 16. Outer diameter D1 of power section 14 can be approximately 4.75 inches (12.065 centimeters) to approximately 7.75 inches (19.685 centimeters). Outer diameter D2 of bearing assembly section 16 can be approximately 6.5 inches (16.51 centimeters) to approximately 9.875 inches (25.0825 centimeters). A ratio (D1/D2) of outer diameter D1 of power section 14 to outer diameter D2 of bearing assembly section 16 can be approximately 0.7307 to approximately 0.8709.

As provided by way of example only, outer diameter D1 of power section 14 can be 6.75 inches (17.145 centimeters), outer diameter D2 of bearing assembly section 16 can be 7.75 inches (19.685 centimeters), and ratio (D1/D2) can be 0.8709. In another example in accordance with the present invention, outer diameter D1 of power section 14 can be 7.75 inches (19.685 centimeters), outer diameter D2 of bearing assembly section 16 can be 9.875 inches (25.0825 centimeters), and ratio (D1/D2) can be 0.7848. In another example, outer diameter D1 of power section 14 can be 6.75 inches (17.145 centimeters), outer diameter D2 of bearing assembly section 16 can be 8 inches (20.32 centimeters), and ratio (D1/D2) can be 0.84375. In yet another example, outer diameter D1 of power section 14 can be 4.75 inches (12.065 centimeters), outer diameter D2 of bearing assembly section 16 can be 6.25 inches (15.875 centimeters), and ratio (D1/D2) can be 0.76.

To accommodate the size difference between outer diameter D1 of power section 14 and outer diameter D2 of bearing assembly section 16, outer diameter D3 of first end 48 of outer crossover sub 18 can be smaller in size than outer diameter D4 of second end 50 of outer crossover sub 18. Outer crossover sub 18 can include tapered surface 51 disposed between first end 48 and second end 50 to transition outer diameter D3 of first end 48 to outer diameter D4 of second end 50 of outer crossover sub 18. Because first end 48 is connected to second end 26 of power section 14, outer diameter D3 of first end 48 of outer crossover sub 18 can be substantially equal in size to outer diameter D1 of power section 14. Because second end 54 of outer crossover sub 18 is connected to first end 34 of bearing assembly section 16, outer diameter D4 of second end 50 of outer crossover sub 18 can be substantially equal in size to outer diameter D2 of bearing assembly section 16. Similar to the ratio (D1/D2) between outer diameter D1 of power section 14 and outer diameter D2 of bearing assembly section 16, a ratio (D3/D4) of outer diameter D3 of first end 48 of outer crossover sub 18 to outer diameter D4 of second end 50 of outer crossover sub 18 can be approximately 0.7307 to approximately 0.8709.

Because outer diameter D1 of power section 14 is smaller than outer diameter D2 of bearing assembly section 16, drilling fluid flows across power section 14 at a higher flow velocity than a typical power section of a typical motor assembly where the power section and the bearing assembly section have the same outer diameter. Because the drilling fluid flows across power section 14 at a higher flow velocity, power section 14 is able to rotate a drill bit at higher speeds than a typical prior art power section. Because the ratio (D1/D2) of outer diameter D1 of power section 14 to outer diameter D2 of bearing assembly section 16 can be approximately 0.7307 to approximately 0.8709, power section 14 is still large enough to produce enough torque to control a reactive torque of the drill bit. Furthermore, with outer diameter D1 of power section 16 being smaller than outer diameter D2 of bearing assembly section 16, less of motor assembly 10 engages the wall of a borehole during operation, thereby reducing the amount of friction that motor assembly 10 encounters during operation as compared to a typical motor assembly.

The difference in size between outer diameter D1 of power section 14 and outer diameter D2 of bearing assembly section 16 also enhances the performance of bearing assembly section 16. Because outer diameter D2 of bearing assembly section 16 is larger than outer diameter D1 of power section 14, radial bearings 38 and thrust bearings 40 can be larger and more robust than a typical bearing assembly section. By enlarging radial bearings 38 and thrust bearings 40, bearing assembly section 16 can be more robust and support more weight on bit than a typical bearing assembly section.

Two boreholes were experimentally drilled in Fayette County, Tex., U.S.A. using motor assembly 10 according to the above-described assembly. In a first run of motor assembly 10, motor assembly 10 took approximately 26 hours to drill a first borehole with a diameter of 9.875 inches (25.0825 centimeters) and with a small radius curve of approximately 46 feet (14 meters). In a second run, motor assembly 10 took approximately 15 hours to drill a second borehole with the same dimensions as the first borehole. In both the first run and the second run, motor assembly 10 included power section 14 with outer diameter D1 having a value of 6.75 inches (17.145 centimeters), and bearing assembly section 16 with outer diameter D2 having a value of 7.75 inches (19.685 centimeters). In the past, prior art motor assemblies utilizing a power section with an 8 inch (20.32 centimeters) diameter and a bearing section also having an 8 inch (20.32 centimeters) diameter would generally require four to six days to drill a borehole of similar dimensions (i.e., a borehole with a diameter of 9.875 inches and a small radius curve of approximately 46 feet).

Persons of ordinary skill in the art will recognize that motor assembly 10 can provide numerous advantages and benefits. By decreasing the drill time and cost of building boreholes with diameters larger than 9 inches (22.86 centimeters) and short radius curves or medium radius curves, operators are able to drill boreholes with short radius curves or medium radius curves that can accommodate a greater variety of borehole casing sizes. Being able to accommodate a greater variety of borehole casing sizes inside a borehole allows an operator the ability to set a case with a large diameter in the borehole, and then proceed to continue drilling the borehole at a smaller diameter and set another case at a smaller diameter. For example, using motor assembly 10, an operator can drill a curved borehole with a diameter of 9.875 inches (25.0825 centimeters) and if the operator encounters a formation with seepage, the operator can set an intermediate casing to block the seepage, and can proceed drilling the borehole at a diameter of 8.75 inches (22.225 centimeters).

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A motor assembly comprising:

a power section extending between a first end and a second end and comprising a housing with an outer diameter;

a bearing assembly section disposed downhole from the second end of the power section and comprising a housing with an outer diameter; and a crossover sub disposed between the power section and the bearing assembly section, the crossover sub comprising:

a first end connected to the second end of the power section; and a second end connected to the bearing assembly section, wherein a ratio of the outer diameter of the housing of the power section to the outer diameter of the housing of the bearing assembly section is approximately 0.7307 to approximately 0.8709, and wherein the first end of the crossover sub has an outer diameter smaller than an outer diameter of the second end of the crossover sub, and wherein a ratio of the outer diameter of the first end of the crossover sub to the outer diameter of the second end of the crossover sub is approximately 0.7307 to approximately 0.8709.

2. The motor assembly of claim 1, wherein the outer diameter of the power section is approximately 2.54 centimeters to approximately 5.715 centimeters smaller than the outer diameter of the bearing assembly section.

3. The motor assembly of claim 2, wherein the outer diameter of the power section is approximately 12.065 centimeters to approximately 19.685 centimeters.

4. The motor assembly of claim 3, wherein of the outer diameter of the bearing assembly section is approximately 16.51 centimeters to approximately 25.0825 centimeters.

5. The motor assembly of claim 1, wherein the motor assembly is a progressing cavity motor.

6. A motor assembly for subterranean drilling, the motor assembly comprising:

a power section extending between a first end and a second end and comprising a housing with an outer diameter;

a bearing assembly section connected to the second end of the power section and comprising a housing with an outer diameter; and a crossover sub disposed between the power section and the bearing assembly section, the crossover sub comprising:

a first end connected to the second end of the power section; and a second end connected to the bearing assembly section, wherein the outer diameter of the housing of the power section is smaller than the outer diameter of the housing of the bearing assembly section, and wherein the first end of the crossover sub has an outer diameter smaller than an outer diameter of the second end of the crossover sub, and wherein a ratio of the outer diameter of the first end of the crossover sub to the outer diameter of the second end of the crossover sub is approximately 0.7307 to approximately 0.8709.

7. The motor assembly of claim 6, wherein a ratio of the outer diameter of the power section to the outer diameter of the bearing assembly section is approximately 0.7307 to approximately 0.8709.

8. The motor assembly of claim 7, wherein the ratio of the outer diameter of the power section to the outer diameter of the bearing assembly section is at least 0.7848.

9. The motor assembly of claim 7, wherein the ratio of the outer diameter of the power section to the outer diameter of the bearing assembly section is at least 0.84375.

10. A downhole drilling motor assembly comprising:

a power section extending between a first end and a second end and comprising a housing with an outer diameter;

a bearing assembly section extending between a first end and a second end and comprising a housing with an outer diameter, wherein the bearing assembly section is disposed downhole from the power section; and a crossover sub disposed between the power section and the bearing assembly section and having a first end connected to the second end of the power section and a second end connected to the first end of the bearing assembly section, wherein the outer diameter of the power section is approximately 2.54 centimeters to approximately 5.715 centimeters smaller than the outer diameter of the bearing assembly section, and wherein the first end of the crossover sub has an outer diameter substantially equal to the outer diameter of the power section, and the second end of the crossover sub has an outer diameter substantially equal to the outer diameter of the bearing assembly section.

11. The downhole drilling motor assembly of claim 10, wherein the bearing assembly section comprises a stabilizer sleeve, the stabilizer sleeve being disposed around the outer diameter of the bearing assembly section.

12. The downhole drilling motor assembly of claim 10, wherein the bearing assembly section comprises a slick sleeve, the slick sleeve being disposed around the outer diameter of the bearing assembly section.

13. The downhole drilling motor assembly of claim 10, wherein the bearing assembly section comprises a mandrel bit box disposed at the second end of the bearing assembly section, wherein the mandrel bit box is configured to connect a drill bit to the bearing assembly section.

14. The downhole drilling motor assembly of claim 13, wherein the bearing assembly section comprises a transmission assembly operatively connected to a rotor of the power section and operatively connected to the mandrel bit box, and wherein the transmission assembly is configured to transfer torque from the rotor of the power section to the mandrel bit box.

* * * * *